United States Patent [19]

Wirtgen

[11] Patent Number: 4,723,867

[45] Date of Patent: Feb. 9, 1988

[54] MACHINE FOR CUTTING ROAD SURFACES

[76] Inventor: Reinhard Wirtgen, Mohner Strasse 2, D-5461 Windhagen, Fed. Rep. of Germany

[21] Appl. No.: 889,863

[22] Filed: Jul. 28, 1986

[30] Foreign Application Priority Data

Aug. 5, 1985 [DE] Fed. Rep. of Germany ..... 3528038

[51] Int. Cl.[4] ..... E01C 23/12

[52] U.S. Cl. ..... 404/90; 299/39

[58] Field of Search ..... 404/90, 91; 299/36, 299/39, 64, 65; 198/518; 37/108 A, 108 R; 172/4.5

[56] References Cited

U.S. PATENT DOCUMENTS

| | | | |
|---|---|---|---|
| 1,449,075 | 3/1923 | Walker | 404/91 X |
| 2,546,907 | 3/1951 | Sherwood | 404/91 |
| 4,037,981 | 7/1977 | Wirtgen | 404/91 |
| 4,041,623 | 8/1977 | Miller et al. | 299/39 X |
| 4,186,968 | 2/1980 | Barton | 404/90 X |
| 4,193,636 | 3/1980 | Jakob | 299/39 |
| 4,325,580 | 4/1982 | Swisher, Jr. et al. | 299/39 |

*Primary Examiner*—Stephen J. Novosad
*Assistant Examiner*—John F. Letchford
*Attorney, Agent, or Firm*—Steinberg & Raskin

[57] ABSTRACT

In a machine for cutting road surfaces, with an undercarriage having its own drive, with a cutting device arranged on it and having at least one cutting roller which extends transversely relative to the direction of travel and around which the cut material runs so as to be conveyed forwardly in the direction of travel, and with a conveyor device in the manner of a belt conveyor, arranged on the undercarriage, for transporting the cut material out of the cutting region to a collecting point, particularly onto a motor truck adjacent to the undercarriage, the conveyor device is arranged in front of the cutting device in the direction of travel at a passage orifice provided in a cover, and a material-collecting flap is arranged behind the cutting device in the direction of travel. The cover, the conveyor device receiving the cut material and the material-collecting flap are each fastened pivotably to the undercarriage, so that the cutting device is easily accessible in order to exchange the cutters.

7 Claims, 3 Drawing Figures

MACHINE FOR CUTTING ROAD SURFACES

BACKGROUND OF THE INVENTION

The invention relates to a machine for cutting road surfaces, with an undercarriage having its own drive and with a cutting device arranged on it and having at least one cutting roller which extends transversely relative to the direction of travel and around which the cut material runs so as to be conveyed forwards in the direction of travel, and with a conveyor device in the manner of a belt conveyor, arranged on the undercarriage, for transporting the cut material out of the cutting region to a collecting point, in particular onto a motor truck adjacent to the undercarriage.

A machine for cutting road surfaces of this generic type is already known, on which is arranged behind the cutting device in the direction of travel a conveyor device which receives the cut material conveyed forwards by the cutting roller and then over and beyond itself to the rear, and which transports it onto a following motor truck. However, transporting away the cut material conveyed into the rear region of the cutting machine entails considerable disadvantages. Thus, the motor trucks have to travel on the part of the road already cut, with the result that considerable quantities of dust and dirt are swirled up and increased tire wear occurs. Furthermore, the approach behind the cutting machine is often blocked by following processing machines. Finally, in modern rebuilding processes, usually only some of the cut material is conveyed away, whilst the remainder remains on the road and is incorporated again together with the new covering layer material. But this material remaining on the road impedes the transport vehicles, so that the modern processes cannot be carried out with such a machine which conveys to the rear.

SUMMARY OF THE INVENTION

The invention is intended to overcome this disadvantage of the known machine.

The object of the invention is, therefore, to provide a machine for cutting road surfaces, in which the cut material is transported into a region where it can easily be picked up by motor trucks.

Starting from a machine of the generic type described in the introduction, this object is achieved, according to the invention, because the conveyor device is arranged in front of the cutting device in the direction of travel and a material-collecting flap is located behind the cutting device in the direction of travel, and the conveyor device end receiving the cut material and the material-collecting flap are each fastened to the undercarriage so as to be vertically adjustable.

The arrangement of the conveyor devcie end receiving the cut material in front of the cutting device makes it possible, in conjunction with the material-collecting flap which slides over the cut road surface, to remove the cut material down to relatively small particles, so that there is no need for additional cleaning, as is often necessary where the known machines are concerned.

Furthermore, the arrangement of the conveyor device in front of the cutting device in the direction of travel makes it possible for the cut material to be picked up by motor trucks which travel along in front of the cutting machine and therefore on the uncut road surface.

At the same time, it has proved expedient to provide, in front of the cutting device in the direction of travel, a cover having a material passage orifice, at which the conveyor device is arranged.

Because of this cover, the cut material collects in front of the cutting device and therefore can pass in a controlled manner through the passage orifice, if appropriate of variable size, onto the conveyor device.

The cutting device usually consisting of a cutting roller is therefore surrounded on all sides, that is to say by the material-collecting flap on the one hand, by the cover and at the top by the machine or a cover plate (not shown in the drawing) located between the machine and the cutting roller. The cut material can consequently only escape via the passage orifice in the cover or remains on the road surface if the materialcollecting flap is guided at a distance above the cut road surface.

However, in practical operation, it is occasionally necessary to renew the worn cutters of the cutting device. In the device described, this proves extremely difficult and time-consuming, because considerable dismantling work is required before the cutting roller is accessible for the exchange operation. According to the invention, this disadvantage is eliminated because the conveyor device receiving the cut material, the cover and the material-collecting flap are each fastened to the undercarriage so that they are vertically adjustable and can be swung away. To exchange the cutters on the machine according to the invention, the conveyor device receiving the cut material, the cover and the material-collecting flap are brought into a position, in which they can no longer impede the exchange of the cutters.

According to an advantageous embodiment of the present invention, a hydraulic lifting or regulating cylinder or the like preferably engaging the cover via two arms is provided for pivoting away the cover and/or the conveyor device. In this way, the cover can be pivoted about an axis extending parallel to the axis of the cutting roller and the front side of the cutting roller thus exposed for the exchange of the cutters.

In a preferred embodiment of the invention, for the vertical adjustment and pivoting of the material-collecting flap about an axis extending parallel to the axis of the cutting roller, the material-collecting flap is equipped with two lateral coaxial bearing journals, each of which engages into an approximately vertical guide groove. The length of the guide groove can be selected so that the material-collecting flap can be pulled out of the range of the cutting roller over its entire height. It is morre advantageous, however, to keep the vertical part of the guide groove relatively small and have it merged at its top end into a curved groove part, as a result of which the material-collecting flap is not only raised, but at the same time also pivoted, when the bearing journals enter the curved groove part. The lifting and pivoting movement of the material-collecting flap consequently remains restricted to the space below the undercarriage, so that the space above the undercarriage can be used for other equipment.

Finally, if in the upper region of the material-collecting flap on the side facing the cutting device, there is a lateral stop for the material-collecting flap and the moveable element of which is articulated on the lower part of the material-collecting flap, then it is possible to obtain a particularly large pivoting angle, whilst ensuring a sufficiently long lift. Consequently, access to the cutting roller when the material-collecting flap is swung away from the latter is particularly good, so that the cutters can be exchanged without difficulty on this side of the roller.

In another preferred embodiment of the invention, the material-collecting flap is provided on its edge adjacent to the cut surface with a hard-metal reinforcement. In addition to the advantage of longer-lasting use of the material-collecting flap because less wear occurs, such a measure also results in improved collection of the cut material. Moreover, if the material-collecting flap is pressed against the cut surface with a certain pressure, the collecting effect can be improved ever further. At the same time, the cut surface is also smoothed somewhat thereby, this being advantageous for subsequent resurfacing.

In a preferred embodiment of the invention, to adjust the height of the conveyor device the end receiving the cut material is connected via articulated levers of a pivoting system to a pivot pin distant from the conveyor device. Such an arrangement makes it possible, on the one hand, to ensure vertical adjustment of the end of the conveyor device so as to be free of horizontal movement in the region near the ground, but at the same time also to obtain a relatively high lift of this end out of the range of the cutting roller, in order to reach the cutter without difficulty.

The pivoting system consists most appropriately of two levers parallel to one another, which at one end are connected to one another via a cross-strut and at their other end are each mounted rotatably on the under-carriage, articulated levers being articulated on the cross-strut, to which is fastened rigidly an actuating lever, on the free end of which a regulating cylinder is articulated. The pivoting of the conveyor device appropriately takes place together with that of the cover which is connected to it and to the passage orifice of which the conveyor device is fastened.

The lifting cylinders used can be hydraulic or pneumatic lifting cylinders, hydraulic lifting cylinders generally being preferred because of the hydraulic system already present on the undercarriage.

BRIEF DESCRIPTION OF THE DRAWINGS

The invention will be explained in detail with reference to the drawing which gives a partially diagrammatic representation of an exemplary embodiment.

In the drawing.

DESCRIPTION OF THE PREFERRED EMBODIMENT

Figure 1:
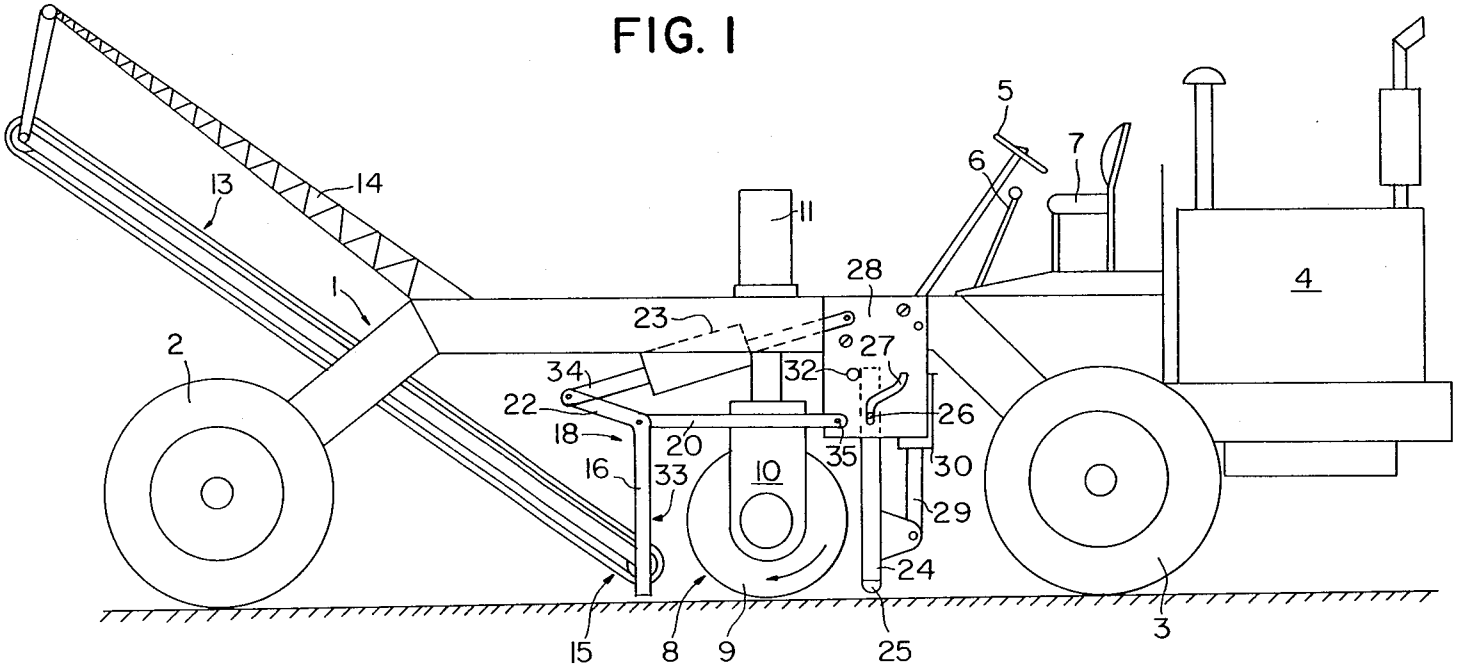
FIG. 1 shows a side view of a machine for cutting road surfaces.
Figure 2:
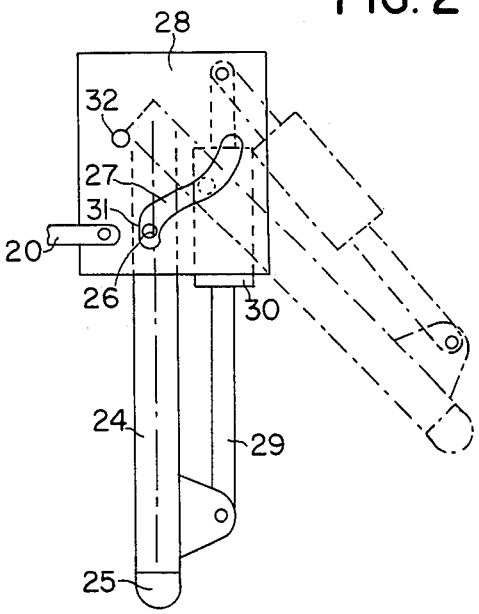
FIG. 2 shows a side view of the material-collecting flap guide.

The machine for cutting road surfaces comprises an undercarriage 1 with a steerable pair of front wheels 2 and a pair of rear wheels 3 which is driven by a diesel engine 4. The driver's cab with the steering wheel 5, a gear-shift lever 6 and a seat 7 is located in front of the diesel engine 4. Arranged between the pair of front wheels 2 and the pair of rear wheels 3 is the cutting device 8 which consists essentially of the cutting roller 9 equipped with hard-metal cutters. The cutting roller 9 is supported in a mounting 10. The mounting 10 is itself fastened to the undercarriage 1 so as to be vertically adjustable by means of a regulating cylinder 11. A hydraulic motor is provided for driving the cutting roller 9.

The cutting roller 9, which rotates in the direction identified by the arrow, cuts the road surface and transports the cut material in the direction of a conveyor device 13 designed as a belt conveyor. The conveyor device 13, which conveys the material beyond the pair of front wheels 2 in the direction of a motor truck traveling in front of the cutting machine, is fastened at one end to a structure 14 arranged on the undercarriage 1, whilst the other end 15 adjacent to the cutting roller 9 terminates at a passage orifice 33 provided in the cover 16 and receives the material flowing out from this orifice 33. At the same time, the conveyor device 13 is appropriately connected to the cover 16 in an articulated manner and can be swung away together with the latter.

Figure 3:
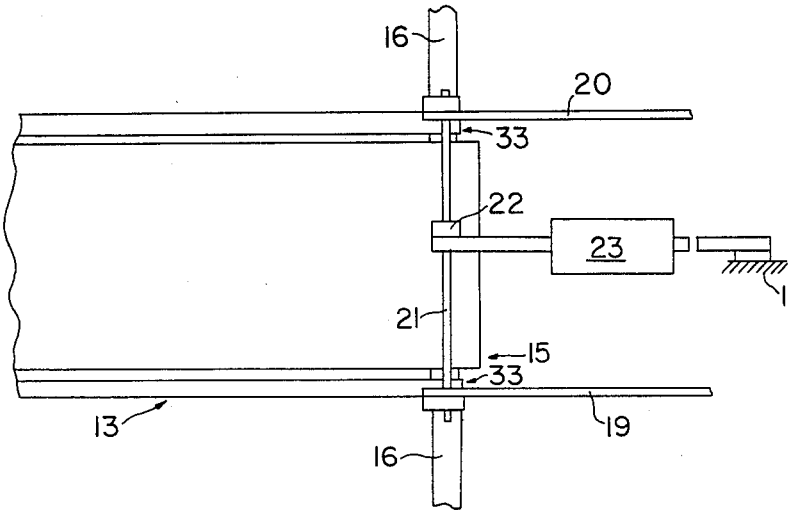
FIG. 3 shows a plan view of the pivoting system of the conveyor device.

As shown in FIG. 3, the pivoting system 18 consists of two levers 19 and 20 parallel to one another, which at one end are connected to one another via a crossstrut 21. At their othe end, the levers 19 and 20 are articulated indirectly on the undercarriage 1 e.g. about respective pivot pins 35. The cover 16 is also fastened to the cross-strut 21. Connected rigidly to the cross-strut 21 and consequently to the cover 16 is an actuating lever 22, on the free end of which is articulated part 34 of a regulating cylinder 23. The other part of the regulating cylinder is fastened pivotably to the undercarriage 1. When the regulating cylinder 23 is actuated, the effective length of the connection between the undercarriage 1 and the actuating lever 22 is consequently increased or reduced, with the result that the actuating lever 22 pivots to the right or to the left and swings away the cover 16 connected rigidly to it and the conveyor device 13 articulated on the latter, so that the cutting roller is exposed.

Located behind the cutting devcie is a material-collecting flap 24 which carries a hard-metal reinforcement 25 at its end facing the ground.

The material-collecting flap has two lateral coaxial bearing journals 26, each of which engages into a groove 27 in a bearing cheek 28. The two bearing cheeks 28 are each fastened on one of the two sides of the under-carriage 1. One part 29 of a hydraulic regulating cylinder 30 is articulated on the lower end of the material-collecting flap 24. The other part of the regulating cylinder 30 is articulated on the undercarriage 1 or the bearing cheek 28. When the regulating cylinder 30 is actuated, the material-collecting flap can consequently be pivoted and, in an end region 31 in which the groove extends approximately vertically, adjusted in terms of its height. Since considerable forces are exerted on the bearing support when the material-collecting flap slides on the cut raod surface, there is advantageously a stop 32, on which the material-collecting flap can be supported during the cutting work.

What is claimed is:

1. A machine for cutting road surface, comprising an undercarriage having its own drive, a cutting device arranged on the undercarriage and having at least one cutting roller which extends transversely relative to a direction of travel and which conveys cut material forwardly in the direction of travel, a conveyor device in the form of a belt conveyor arranged on the undercarriage for transporting the cut material out of a cutting region to a collecting point, wherein the conveyor device (13) is arranged in front of the cutting device (8) in the direction of travel, a material-collecting flap (24) is located behind the cutting device (8) in the direction of travel, an end (15) of the conveyor device (13) receiving the cut material and the material-collecting flap (24) are each fastened to the undercarriage (1) so as to be vertically adjustable, wherein there is, in front of the cutting device (8) in the direction of travel, a cover (16) having a material passage orifice (33), at which the conveyor device (13) is arranged, and means mounting the cover (16) together with the conveyor device (13) so that the cover and the conveyor device can be swung away forwardly.

2. A machine as claimed in claim 1, wherein a regulating cylinder (23) engaging the cover (16) via an arm (22) is provided for pivoting away the cover (16) and the conveyor device (13).

3. A machine as claimed in claim 1, wherein the material-collecting flap (24) is provided with a hard-metal reinforcement (25) on an edge thereof adjacent to the cut surface.

4. A machine as claimed in claim 1, wherein, to adjust the height of the material-collecting flap (24), the flap has two lateral coaxial bearing journals (26), each of which engages into an approximately vertical guide groove (31) in a bearing cheek (28) fastened to the undercarriage (1).

5. A machine as claimed in claim 4, additionally comprising a lateral stop for the material-collecting flap (24) on one of the bearing cheeks (28) adjacent an upper region of the material-collecting flap (24) on the side facing the cutting device (8), and a lifting cylinder (30) with a moveable element (29) thereof which is articulated on a lower part of the material-collecting flap (24), for pivoting the materialcollecting flap.

6. A machine for cutting road surfaces, comprising an undercarriage having its own drive, a cutting device arranged on the undercarriage and having at least one cutting roller which extends transversely relative to a direction of travel and which conveys cut material forwardly in the direction of travel, a conveyor device in the form of a belt conveyor arranged on the undercarriage for transporting the cut material out of a cutting region to a collecting point, wherein the conveyor device (13) is arranged in front of the cutting device (8) in the direction of travel, a material-collecting flap (24) is located behind the cutting device (8) in the direction of travel, an end (15) of the conveyor devcie (13) receiving the cut material and the material-collecting flap (24) are each fastened to the undercarriage (1) so as to be vertically adjustable, wherein, to adjust the height of the material-collecting flap (24), the flap has two laterial coaxial bearing journals (26), each of which engages into an approxiamtely vertical guide groove (31) in a bearing cheek (28) fastened to the undercarriage (1), and wherein each guide groove (31) merges at its top end into a curved groove part (27).

7. A machine for cutting road surfaces, comprising an undercarriage having its own drive, a cutting device arranged on the undercarriage and having at least one cutting roller which extends transversely relative to a direction of travel and which conveys cut material forwardly in the direction of travel, a conveyor device in the form of a belt conveyor arranged on the undercarriage for transporting the cut material out of a cutting region to a collecting point, wherein the conveyor device (13) is arranged in front of the cutting device (8) in the direction of travel, a material-collecting flap (24) is located behind the cutting device (8) in the direction of travel, an end (15) of the conveyor device (13) receiving the cut material and the material-collecting flap (24) are each fastened to the undercarriage (1) so as to be vertically adjustable, and wherein there is, in front of the cutting device (8) in the direction of travel, a cover (16) having a material passage orifice (33), at which the conveyor device (13) is arranged and wherein, for vertically adjusting the conveyor device (13), the end (15) thereof receiving the cut material is connected via articulated levers (19, 20) to a pivot pin distant from a conveyor device.

* * * * *